US006216321B1

(12) United States Patent
Bakker et al.

(10) Patent No.: US 6,216,321 B1
(45) Date of Patent: Apr. 17, 2001

(54) EDGE CLIP

(75) Inventors: John H. Bakker, Cortland; William G. Flask, Youngstown, both of OH (US); Vickey E. Reed, Beaver Falls, PA (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/343,865

(22) Filed: Jun. 30, 1999

(51) Int. Cl.[7] ..... A44B 21/00

(52) U.S. Cl. ..... 24/459; 248/217.3; 248/231.81; 439/575

(58) Field of Search ..... 24/459, 546; 248/216.1, 248/217.3, 231.81, 225.21; 439/575, 569

(56) References Cited

U.S. PATENT DOCUMENTS

| | | | | |
|---|---|---|---|---|
| 1,840,409 | * | 1/1932 | Randall | 24/459 |
| 2,057,078 | * | 10/1936 | Abramson | 439/575 |
| 2,172,347 | * | 9/1939 | Clemence | 439/575 |
| 2,183,377 | * | 12/1939 | Wolf | 439/575 |
| 2,620,376 | * | 12/1952 | Benander | 439/575 |
| 2,974,383 | * | 3/1961 | Bright | 248/217.3 X |
| 3,730,466 | * | 5/1973 | Swanquist | 248/217.3 X |
| 4,471,414 | * | 9/1984 | Savage, Jr. | 362/226 |
| 5,033,529 | * | 7/1991 | Koschade | 24/459 X |
| 5,451,167 | * | 9/1995 | Zielinski et al. | 439/92 |
| 5,606,777 | * | 3/1997 | Lu | 24/67.9 |
| 5,622,508 | * | 4/1997 | Nagahata et al. | 439/79 |
| 5,702,267 | * | 12/1997 | Chen | 439/419 |
| 5,788,205 | * | 8/1998 | Hansen | 248/475.1 |
| 5,892,659 | * | 4/1999 | Cooper et al. | 439/575 X |
| 5,912,648 | * | 6/1999 | Walthers | 343/713 |
| 5,941,616 | * | 8/1999 | Billingham | 312/111 |

* cited by examiner

*Primary Examiner*—Lynne H. Browne
*Assistant Examiner*—John R. Cottingham
(74) *Attorney, Agent, or Firm*—Richard A. Jones

(57) ABSTRACT

An edge clip which uses precoated sheet metal stock, is stamped in a high speed progressive die, and has a robustly configured triangularly shaped body. A solid blank of the sheet stock is die cut into a patterned blank including a base, a projection forward of the base, and first and second wings located at either side of the base. Each of the first and second wings has an outboard member and an inboard member, wherein the outboard member includes a barb. A pointed flange projects from the rear edge of the patterned blank at each of the first and second wings. The projection is stamped to form a standard attachment appendage, and the first and second wings are folded, wherein a spring arm is formed at an apex thereof and provided by an overlap of the outboard members. A tab of the outboard member of the second wing secures the overlap of the outboard members. The folding also provides first and second rails, wherein each is radiused to provide a basal corner of the triangular configuration. Each of the first and second rails project in parallel with the overlapped spring arm, are separated therefrom, respectively, by radiused first and second upper slots, and are separated from the platform, respectively, by first and second lower slots. Finally, each of the pointed flanges are folded into mutual abutment rearwardly of the first and second upper slots, in spaced relation to the base.

14 Claims, 6 Drawing Sheets

EDGE CLIP

TECHNICAL FIELD

The present invention relates to edge clips for attaching an article to a planar edge, most notably an electrical connector to a flat planar metallic or plastic edge of a support member.

BACKGROUND OF THE INVENTION

Referring to FIG. 1 a first configuration of a prior art edge clip 10 is depicted, having an S-shaped configuration characterized by an attachment appendage 12 in the form of a serrated male component 12*a* and a U-shaped clip component 14 having a pair of barbs 16. The prior art edge clip 10 is manufactured from bare mild steel using a three step process. The first step involves a multi-slide press at 200 strokes or less per minute, the second step involves heat treating, and the third step involves barrel plating. These three steps each having inherent variability and have over the years caused problems.

FIG. 2 shows a second configuration of a prior art edge clip 10' having the aforesaid U-shaped clip component 14, but now having an attachment appendage 12' in the form of a platform 18 with a projecting tongue 20, the tongue being displaced vertically from the platform and having a slot 22 and an upturned leading edge.

Operation with respect to a prior art electrical connector 24 shown at FIGS. 3 and 3A, by way of example, will now be briefly discussed. With respect to the first configuration of the prior art edge clip 10, the male component 12 is machine thrust into a dual-slotted seat 26 of the connector 24. Thereafter, the clip component 14 is slipped onto the edge of a planar edged article, as for example a metal or plastic support member, so as to thereby supportably affix the electrical connector 24 with respect to the support member. With respect to the second configuration of the prior art edge clip 10', the platform 18 is manually slipped into a dual-slotted seat 26 of the connector and the slot 22 of the tongue 20 rides over a ramped locking nib 28 whereupon the nib is received by the slot. Thereafter, the clip component 14 is slipped onto the edge of a planar edged article, as for example a metal or plastic support member, so as to thereby supportably affix the electrical connector 24 with respect to the support member.

However, due to the manufacturing processes involved in making the prior art edge clip 10, 10' which result in quality assurance problems and unacceptable production cost, there remains needed in the art an edge clip of superior configuration which has none of the aforesaid detractions.

SUMMARY OF THE INVENTION

The present invention is an edge clip which uses precoated sheet metal stock, is stamped in a standard progressive die at a rate of 1,000 or more strokes per minute, and is not subject to the quality and cost problems associated with the prior art edge clip configurations.

The edge clip according to the present invention has a robustly configured triangularly shaped body formed from precoated sheet metal blank stock (for example HSLA sheet stock). A solid blank of the sheet stock is die cut into a patterned blank including a base, a projection forward of the base, and first and second wings located at either side of the base. Each of the first and second wings has an outboard member and an inboard member, wherein the outboard member includes a barb. A pointed flange projects from the rear edge of the patterned blank at each of the first and second wings.

The projection is stamped to form an attachment appendage having a platform and a slotted tongue, and the first and second wings are folded into a triangular shape, wherein at an apex thereof is formed an overlapped spring arm provided by an overlap of the outboard members of the wings such that the barbs point toward the platform. A tab of the second wing secures the overlap of the outboard members, thereby unifying the overlapped spring arm. The folding of the first and second wings further provides, respectively, first and second rails, wherein each provides a basal corner of the triangular configuration. Each of the first and second rails project in parallel with the overlapped spring arm, are separated therefrom, respectively, by radiused first and second upper slots, and are separated from the platform, respectively, by first and second lower slots. Each of the pointed flanges are folded into mutual abutment rearwardly of the first and second upper slots, in spaced relation to the base.

The edge clip according to the present invention is designed to be a high speed progressive die manufactured part. The overlap feature of the overlapped spring arm, wherein load and stress are shared by the overlapped left and right outboard members, via the tab, insure that the overlapped spring arm moves in unison. The radial shape of the overlapped spring arm, as well as the radial shape of the first and second rails provide a robust and strong edge clip structure. All surfaces of the edge clip have generous radii so as to be ergonomically friendly to the touch. Radii at the base of the overlapped spring arm provides distribution of the stress during deflection when the edge clip receives a planar edge of a support surface. The symmetrical shape of the triangular configuration provides good capability for forming and dimensional control of the gap at the first and second upper slots. The material used for the edge clip allows for the elimination of the heat treat process used in the conventional edge clip designs, which in those prior art edge clip was subject of dimensional variation and less capable performance. The superior features and performance of the edge clip according to the present invention is accomplished through the unique triangular geometry, which facilitates the high speed manufacturing process.

Accordingly, it is an object of the present invention to provide an edge clip which is of a triangular configuration which is formable from a solid sheet blank via a high speed progressive die.

It is an additional object of the present invention to provide an edge clip of a triangular configuration having an overlapped spring arm at an apex of the triangular configuration, and a pair of rails which form the basal corners of the triangular configuration, wherein a planar edge is clippable therebetween.

It is another object of the present invention to provide a triangularly configured edge clip which is robust and has superior performance, lower manufacturing cost, and fewer processing steps than that of prior art edge clips.

These, and additional objects, advantages, features and benefits of the present invention will become apparent from the following specification.

DESCRIPTION OF THE PREFERRED EMBODIMENT

Figure 1:
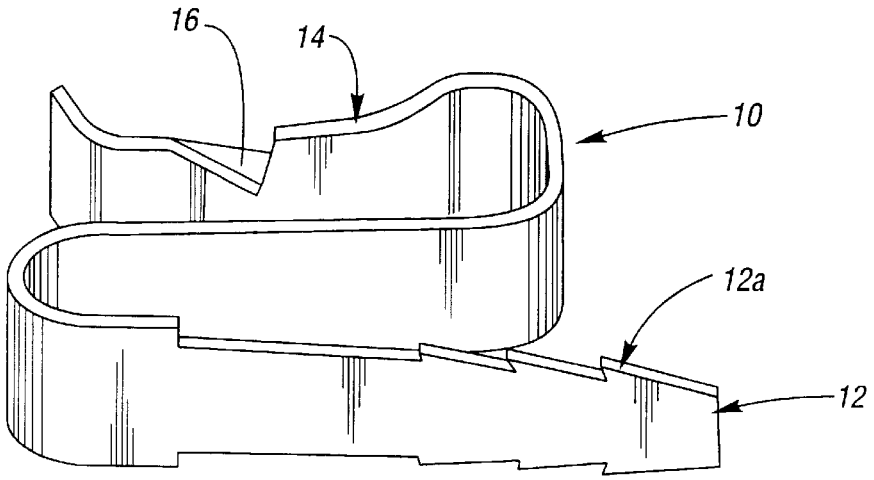
Prior Art Fig. 1
FIG. 1 is a perspective view of a prior art edge clip of a first configuration.
Figure 2:
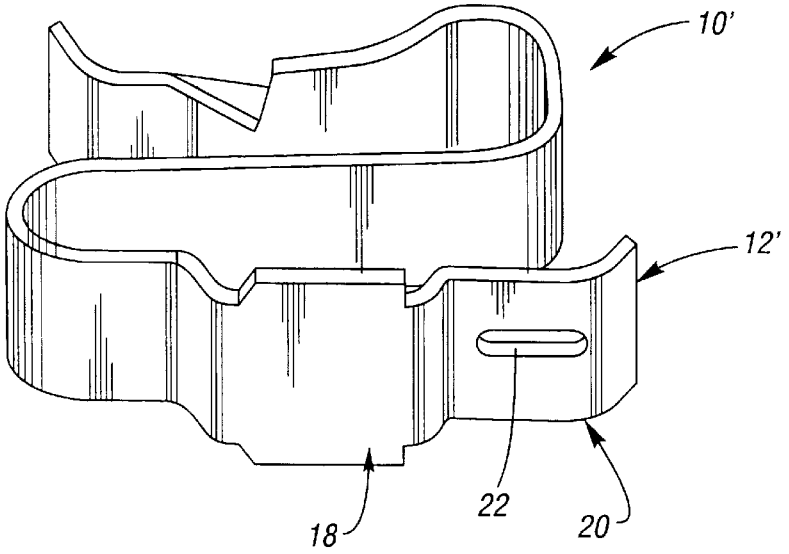
Prior Art Fig. 2
FIG. 2 is a perspective view of a prior art edge clip of a second configuration.
Figure 3:
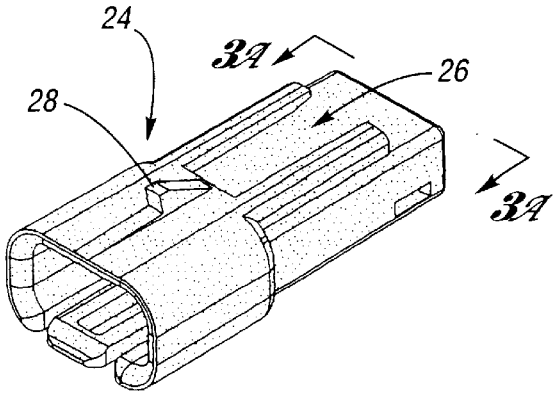
Prior Art Fig. 3
FIG. 3 is a perspective view of a prior art electrical connector for interfacing with an edge clip.
Figure 3A:
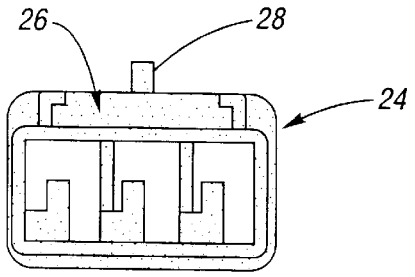
Prior Art Fig. 3A
FIG. 3A is an end view of the prior art electrical connector as seen along line 3A—3A of FIG. 3.
Figure 4:
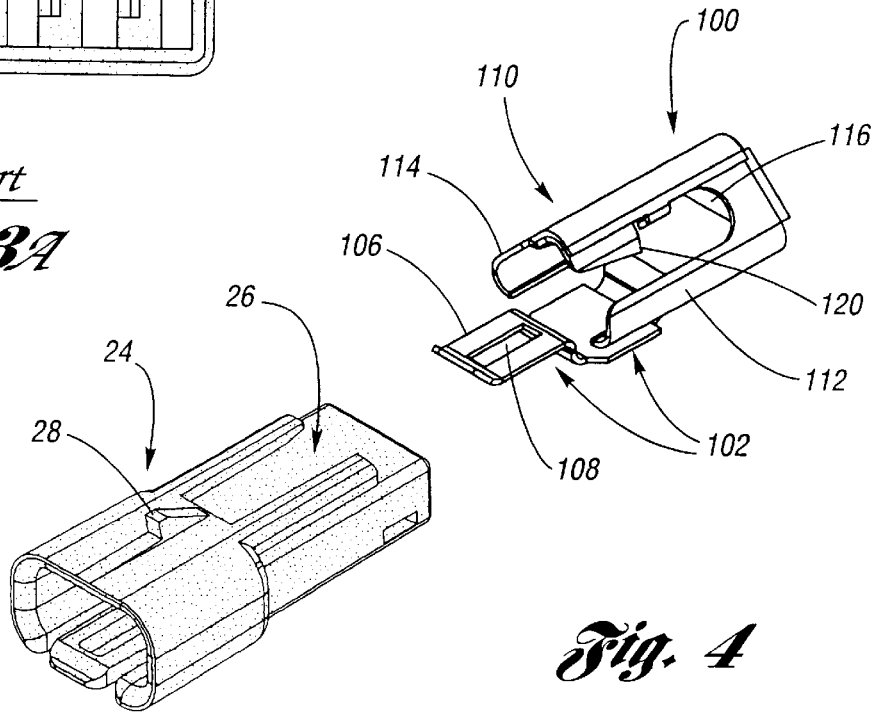
FIG. 4 is an exploded perspective view of an edge clip according to the present invention and the prior art electrical connector of FIG. 3.

Referring now to the Drawings, FIGS. 4 through 13C generally depict various aspects of the edge clip 100 according to the present invention. As can be seen by reference to FIGS. 4 and 5, the edge clip 100 has an attachment appendage 102 including a platform 104 and a projecting tongue 106 having a slot 108 and an upturned leading edge of the kind known in the art for interfacing with articles having a dual-slotted seat 26 and a ramped nib 28, as for example a prior art electrical connector 24. In this regard either side of the platform is slid receivably into a respective slot of the dual-slotted seat, and the ramped nib 28 is received into the slot 108 to thereby secure the edge clip to the article 24.

Figure 5:
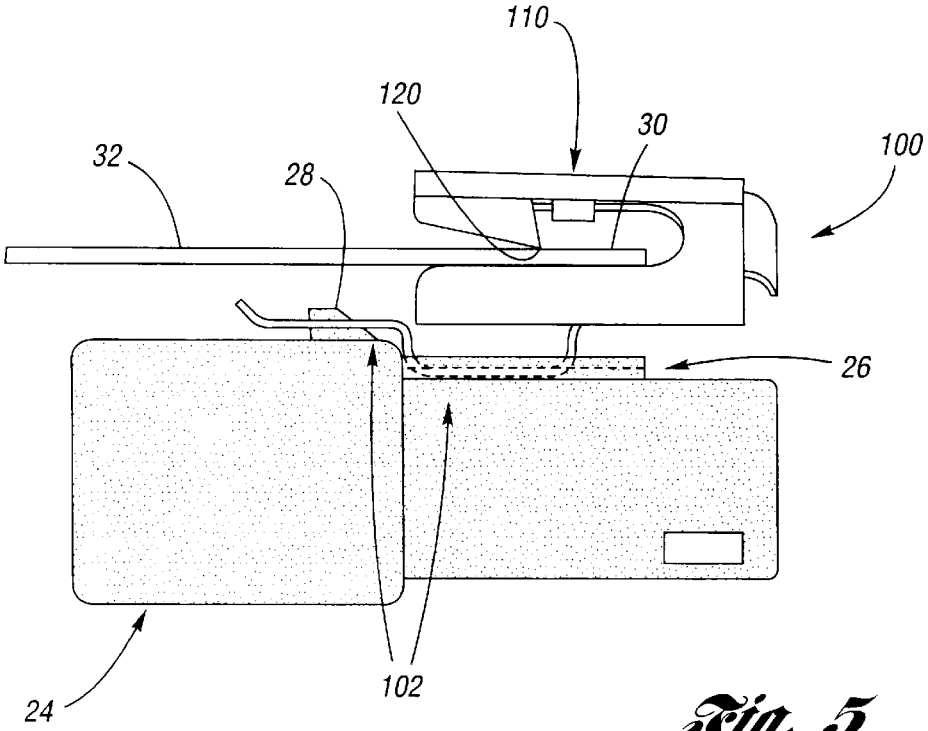
FIG. 5 is a side view of the edge clip according to the present invention mated to the prior art electrical connector and to a planar edge of a support member.

With further reference to FIG. 5, the edge clip 100 is shown clipped to a planar edge 30 of a support member 32, which may be any for example metal or plastic planar item to which the edge clip, and its associated article 24, is to be secured. In this regard, it will be noted that the planar edge 30 is trapped between an overlapped spring arm 110 and first and second rails 112, 114, by being received into first and second upper slots 116, 118, respectively (see FIG. 7). A pair of barbs 120 (see FIG. 8) engage the planar edge 30 and serve as a retention aid whereby accidental dislodgement is prevented.

With reference now being directed to FIGS. 6 through 12, the structural configuration of the edge clip 100 will be further detailed.

Figure 6:
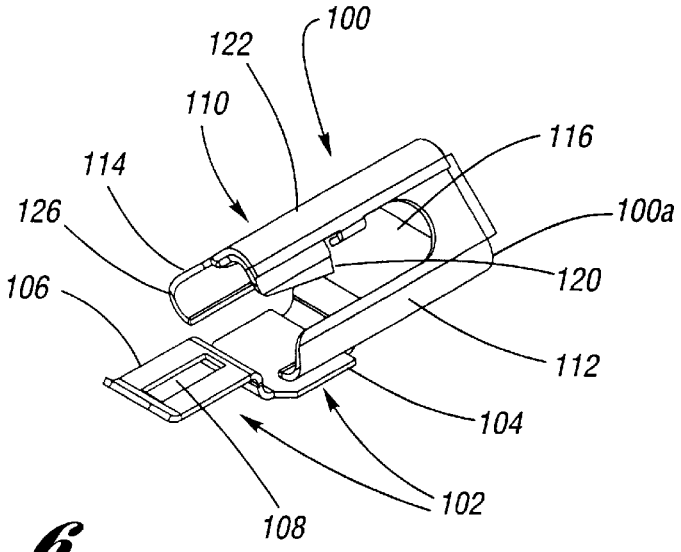
FIG. 6 is a perspective view of the edge clip according to the present invention.
Figure 7:
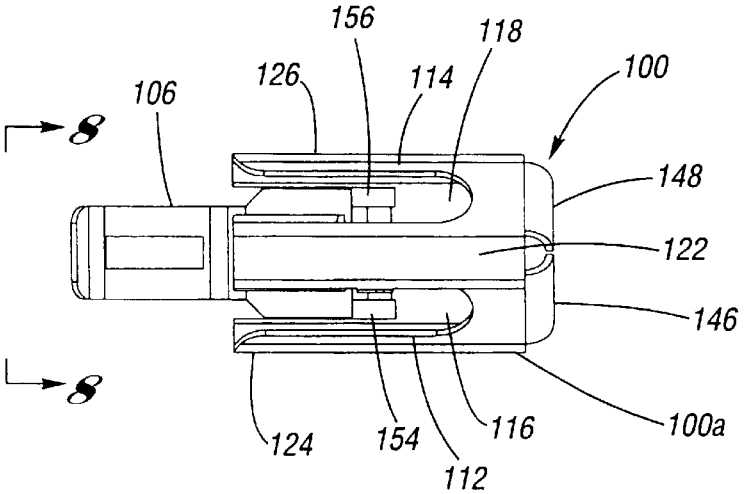
FIG. 7 is a top plan view of the edge clip according to the present invention.
Figure 8:
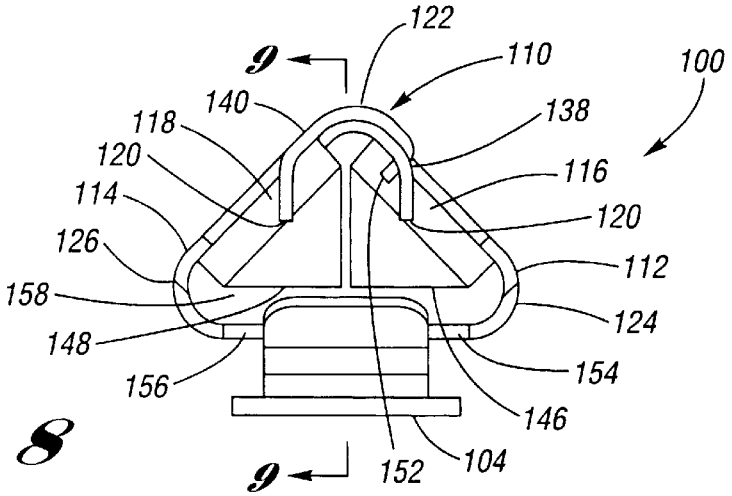
FIG. 8 is a front end view of the edge clip according to the present invention as seen along line 8—8 of FIG. 7.
Figure 9:
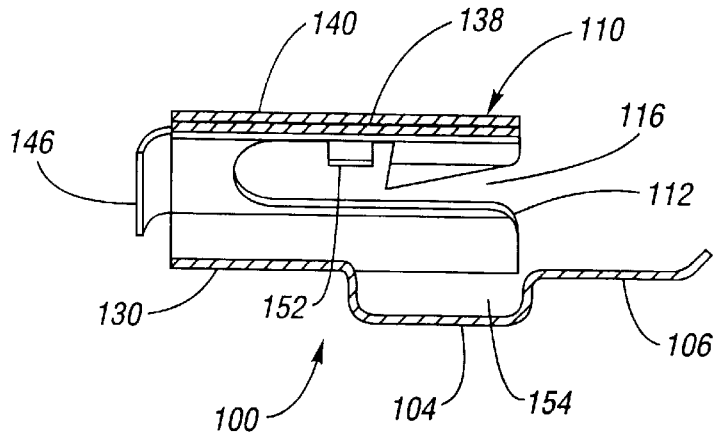
FIG. 9 is a partly sectional view of the edge clip according to the present invention as seen along line 9—9 of FIG. 8.
Figure 10:
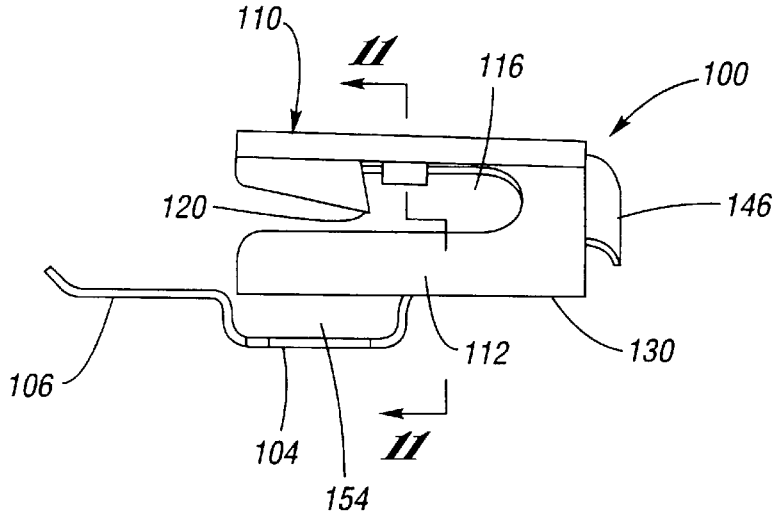
FIG. 10 is a side plan view of the edge clip according to the present invention.
Figure 11:
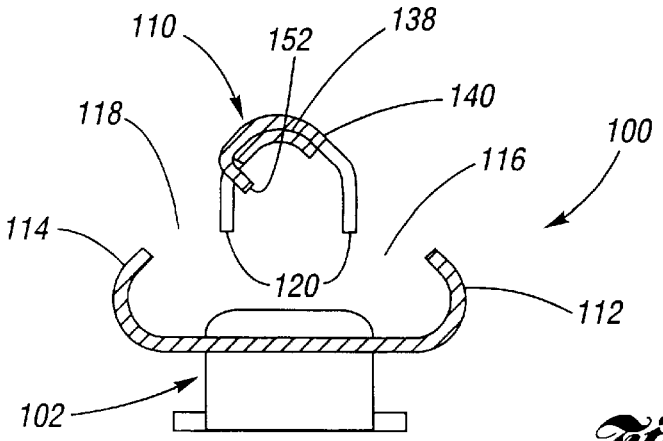
FIG. 11 is a partly sectional view of the edge clip according to the present invention as seen along line 11—11 of FIG. 10.
Figure 12:
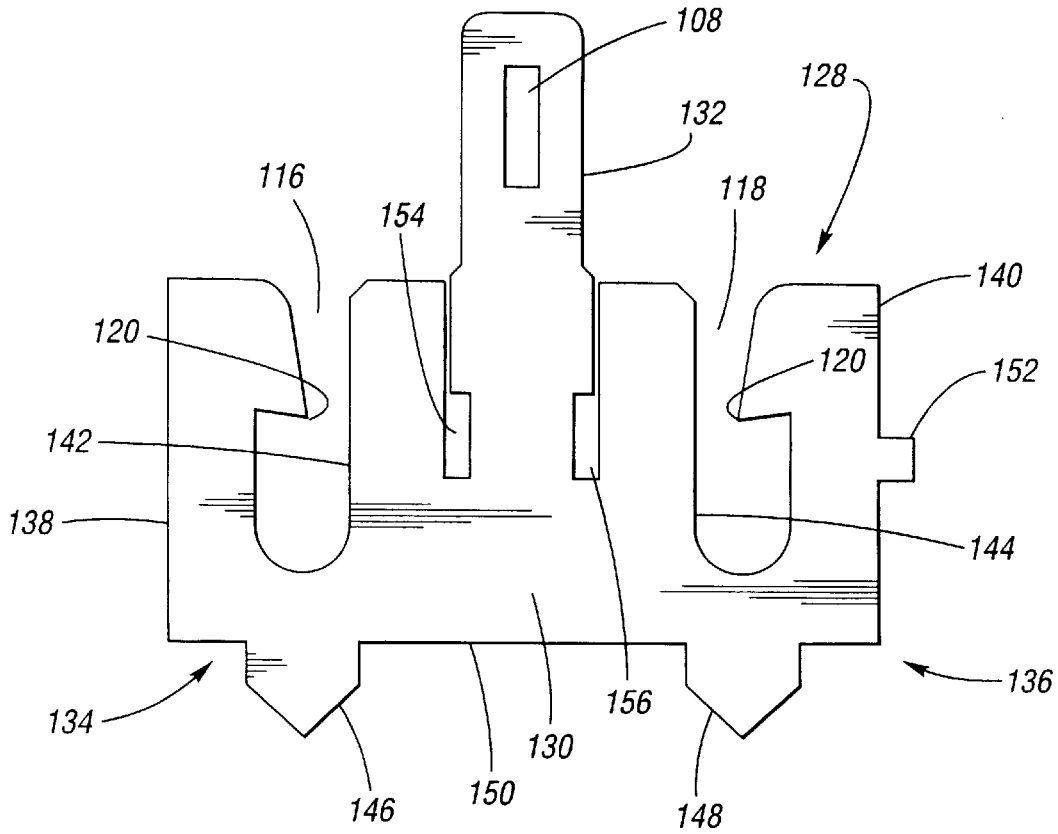
FIG. 12 is a top plan view of a patterned blank for foldably forming the edge clip according to the present invention.

As shown at FIGS. 6 and 7, the edge clip 100 has a robustly configured triangularly shaped body 100*a* defined by an apex 122, and left and right basal corners 124, 126. As shown at FIG. 12, a solid blank of sheet stock is die cut into a patterned blank 128 including a base 130, a projection 132 forward of the base, and first and second wings 134, 136 located at either side of the base. Each of the first and second wings 134, 136 has a respective first and second outboard member 138, 140 and a respective first and second inboard member 142, 144, wherein the first and second outboard members each include a barb 120. A pointed flange 146, 148 projects from the rear edge 150 of the patterned blank 128 at each of the first and second wings 134, 136.

The projection 132 is stamped to form the attachment appendage 102, as structurally recounted hereinabove. The first and second wings are folded into the aforementioned triangular shape, wherein (see FIG. 8) at the apex 122 is formed by radiusing of the overlapped spring arm 110, and wherein the overlapped spring arm is a result of overlap of the first and second outboard members 138, 140, wherein the barbs 120 point toward the platform 104. A tab 152 of the second outboard member 140 secures the overlap of the first and second outboard members 138, 140, thereby unifying the overlapped spring arm 110.

The folding of the first and second wings 134, 136 also provides, respectively, the first and second rails 112, 114, wherein each of the first and second rails are respectively radiused to provide the first and second basal corners 124, 126. Each of the first and second rails 112, 114 project in parallel with the overlapped spring arm 110 and are separated therefrom, respectively, by the first and second upper slots 116, 118. The first and second upper slots 116, 118 are rearwardly radiused and respectively separated from the platform 104 by the first and second lower slots 154, 156, which allow for the platform to engage the dual-slotted seat 26. Each of the pointed flanges 146, 148 are folded into mutual abutment rearwardly of the first and second upper slots 116, 118, in spaced relation to the base 130 via a rear slot 158, wherein the abutment of the pointed flanges serves to enhance robustness of the triangularly shaped body 100*a*.

Figure 13A:
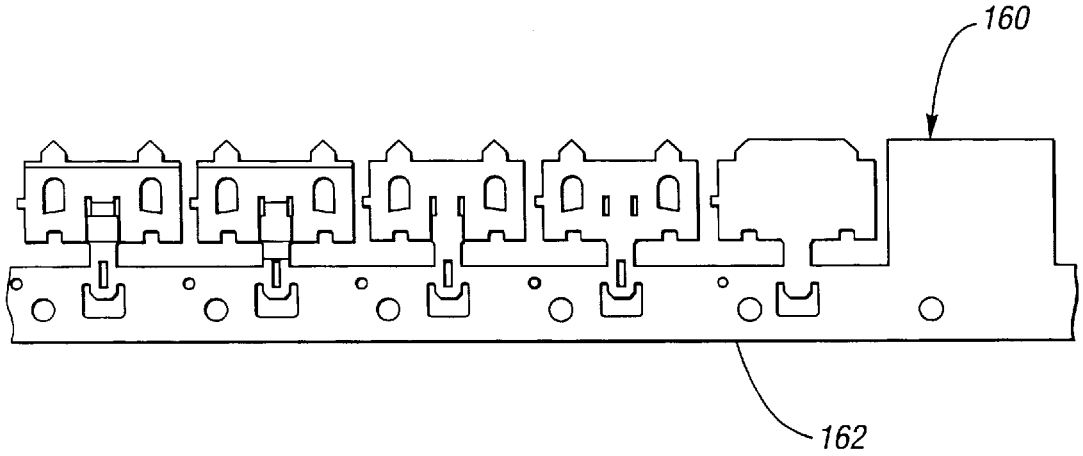
FIGS. 13A through 13C are a progressive depiction of the die cutting and folding steps in the production of a sheet metal solid blank into a finished edge clip according to the present invention.
Figure 13B:
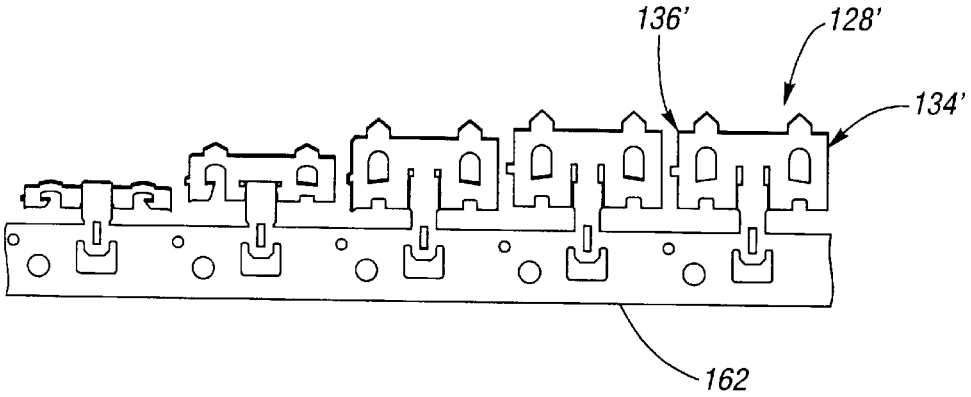
Figure 13C:
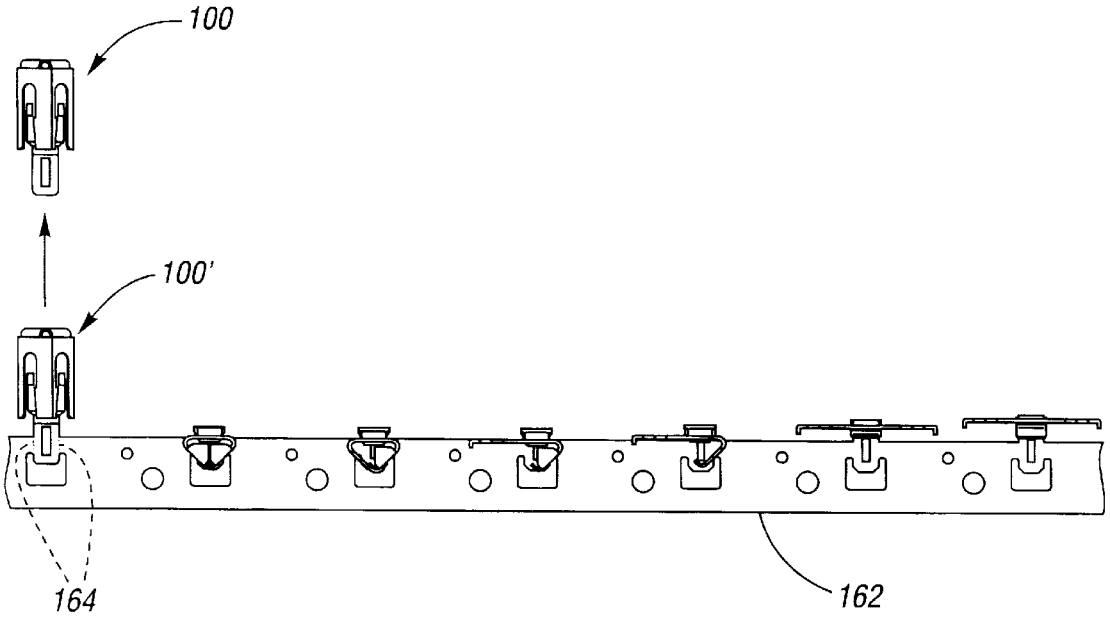

FIGS. 13A through 13C depict an example of the progressive the steps to die cut and fold a solid blank 160 into the edge clip 100. In this regard, a strip 162 provide a fixture for processing the solid blank 160. At an intermediate stage of die cutting, a patterned blank 128' is formed, which generally shares a resemblance with the patterned blank 128 of FIG. 12. The patterned blank 128' includes first and second wings 134' 136' which are then in succeeding steps folded to form the nearly finished edge clip 100', wherein the finished edge clip 100 is provided upon execution of die cuts 164 (shown as dashed lines).

To those skilled in the art to which this invention appertains, the above described preferred embodiments may be subject to change or modification. Such change or modification can be carried out without departing from the scope of the invention, which is intended to be limited only by the scope of the appended claims.

What is claimed is:

1. An edge clip comprising:

a sheet metal body having a triangular shape defined by an apex, a first basal corner and a second basal corner, said body comprising:

a base located between said first and second basal corners;

a first rail formed at said first basal corner and connected with said base;

a second rail formed at said second basal corner and connected with said base;

a spring arm formed at said apex and connected with said first and second rails; and an attachment appendage connected with said base;

wherein said first rail is separated from said spring arm by a first upper slot, said second rail is separated from said spring arm by a second upper slot, said first rail is separated from said attachment appendage by a first lower slot, and said second rail is separated from said attachment appendage by a second lower slot.

2. The edge clip of claim 1, wherein said spring arm comprises a first member connected with said first rail overlapped by a second member connected with said second rail, said second member having a tab, said tab being folded onto said first member to thereby interconnect said first and second members.

3. The edge clip of claim 2, wherein said spring arm further comprises a first barb connected with said first member and a second barb connected with said second member.

4. The edge clip of claim 3, wherein said spring arm is radiused to form said apex, said first rail is radiused to form said first basal corner, and said second rail is radiused to form said second basal corner.

5. The edge clip of claim 4, wherein said attachment appendage comprises a platform connected with said base, and a slotted tongue connected with said platform, wherein said first and second lower slots are located at said platform.

6. The edge clip of claim 5, further comprising:

a first pointed flange connected with said first rail; and a second pointed flange connected with said second rail;

wherein said first and second pointed rails mutually abut in transverse relation to said base and in spaced relation to said base.

7. An edge clip for connecting with a first article having a double-slotted seat and ramped nib, and for further connecting with a planar edged second article, said edge clip comprising:

a sheet metal body having a triangular shape defined by an apex, a first basal corner and a second basal corner, said body comprising:

a base located between said first and second basal corners;

a first rail formed at said first basal corner and connected with said base;

a second rail formed at said second basal corner and connected with said base;

a spring arm formed at said apex and connected with said first and second rails, said spring arm having a pair of barbs; and an attachment appendage connected with said base, wherein said attachment appendage comprises a platform connected with said base, and a slotted tongue connected with said platform, wherein said first and second lower slots are located at said platform;

wherein said first rail is separated from said spring arm by a first upper slot, said second rail is separated from said spring arm by a second upper slot, said first rail is separated from said attachment appendage by a first lower slot, and said second rail is separated from said attachment appendage by a second lower slot; and wherein said attachment appendage is connectable to a first article having a double-slotted seat and ramped nib, and wherein a planar edged second article is receivable into said first and second upper slots and held thereat by said pair of barbs.

8. The edge clip of claim 7, wherein said spring arm comprises a first member connected with said first rail overlapped by a second member connected with said second rail, said second member having a tab, said tab being folded onto said first member to thereby interconnect said first and second members.

9. The edge clip of claim 8, wherein said spring arm is radiused to form said apex, said first rail is radiused to form said first basal corner, and said second rail is radiused to form said second basal corner.

10. The edge clip of claim 9, further comprising:

a first pointed flange connected with said first rail; and a second pointed flange connected with said second rail;

wherein said first and second pointed rails mutually abut in transverse relation to said base and in spaced relation to said base.

11. A method for making an edge clip, comprising the steps of:

forming a patterned blank from a solid blank of sheet metal stock, said patterned blank having a base, a projection forward of the base, and first and second wings located at either side of the base, wherein each of the first and second wings has a respective first and second outboard member and a respective first and second inboard member, wherein the second outboard member includes a tab and each the first and second outboard members include a barb, and wherein a pointed flange projects from a rear edge of the patterned blank at each of the first and second wings;

forming the projection into an attachment appendage comprising a platform connected to the base and a slotted tongue connected to the platform;

folding the first and second wings into a triangular shape defined by an apex, a first basal corner and a second basal corner; wherein an overlapped spring arm is radiused to form the apex and formed of an overlap of the first and second outboard members, wherein the barbs point toward the platform, and wherein the tab is bent over the first outboard member to thereby secure the overlap of the first and second outboard members and unifying the overlapped spring arm; wherein a first rail is formed of the first inboard member and is radiused to form the first basal corner and a second rail is formed of the second inboard member and is radiused to form the second basal corner; and wherein each of the first and second rails project in parallel with the overlapped spring arm and are separated therefrom, respectively, by first and second upper slots; and wherein the first and second rails are separated from the platform, respectively, by first and second lower slots; and folding the first and second pointed flanges into mutual abutment rearwardly of the first and second upper slots in spaced relation to the base.

12. An edge clip product made according to the method of claim 11.

13. The method of claim 11, wherein said forming is provided by a high speed progressive die.

14. The method of claim 13, wherein said solid blank is formed of precoated sheet metal stock.

* * * * *